United States Patent [19]

Loechner et al.

[11] Patent Number: 4,561,416

[45] Date of Patent: Dec. 31, 1985

[54] SELF-CONTAINED PORTABLE OVEN AIR CIRCULATOR

[75] Inventors: John T. Loechner, Westport; Kurt J. Kruger, Huntington, both of Conn.; John R. Nottingham, Richmond Heights; Joe M. Golembek, Cleveland Heights, both of Ohio

[73] Assignee: The Associates Group Partners, Westport, Conn.

[21] Appl. No.: 484,494

[22] Filed: Apr. 13, 1983

[51] Int. Cl.[4] ..... D24C 15/32

[52] U.S. Cl. ..... 126/21 A; 185/40 F; 98/40.29

[58] Field of Search ..... 126/21 A; 185/40 F, 185/DIG. 1; 116/284, 298; 415/126, 127; 417/328; 98/40 V

[56] References Cited

U.S. PATENT DOCUMENTS

| | | | |
|---|---|---|---|
| 879,580 | 2/1908 | Pearsall | 417/328 |
| 1,362,653 | 12/1920 | Turner | 185/37 |
| 1,365,455 | 1/1921 | Chapman | 185/40 F |
| 1,923,995 | 8/1933 | Nock | 185/DIG. 1 |
| 2,029,406 | 2/1936 | Birkholz | 98/40 V |
| 2,412,103 | 12/1946 | Spooner | 126/21 A X |
| 3,246,690 | 4/1966 | Fry | 126/21 A X |
| 3,255,746 | 6/1966 | Jenn et al. | 126/21 A |
| 3,991,737 | 11/1976 | Del Fabbro | 126/21 A |
| 4,071,739 | 1/1978 | Jenn et al. | 126/21 A X |
| 4,089,322 | 5/1978 | Guibert | 219/400 X |
| 4,099,480 | 7/1978 | Loustaunau | 116/284 X |
| 4,108,139 | 8/1978 | Gilliom et al. | 126/21 A |
| 4,109,636 | 8/1978 | Burge | 126/21 A |
| 4,262,183 | 4/1981 | Smith et al. | 126/21 A X |
| 4,345,540 | 8/1982 | Karmin | 116/298 X |
| 4,365,930 | 12/1982 | Ogura et al. | 98/40 V X |
| 4,369,760 | 1/1983 | Jorgensen et al. | 126/21 A |
| 4,381,443 | 4/1983 | Guibert | 126/21 A X |
| 4,457,292 | 7/1984 | Jorgensen et al. | 126/21 A |
| 4,457,672 | 7/1984 | Ogura et al. | 415/126 X |

FOREIGN PATENT DOCUMENTS

| | | | |
|---|---|---|---|
| 1251880 | 11/1971 | United Kingdom | 98/40 V |

*Primary Examiner*—Samuel Scott
*Assistant Examiner*—Allen J. Flanigan
*Attorney, Agent, or Firm*—Louis H. Reens

[57] ABSTRACT

An air circulator for an oven is described formed of a self-contained housing sized to be placed at a convenient location inside the oven with food being heated. The housing encloses a spring motor and a propeller connected to the motor through a reduction gear train. An air flow is produced from a housing outlet adjacent the propeller and may be directed in a desired direction by a rotatably adjustable air flow deflector on the housing and at the outlet.

10 Claims, 9 Drawing Figures

SELF-CONTAINED PORTABLE OVEN AIR CIRCULATOR

FIELD OF THE INVENTION

This invention relates to a device for circulating air in an oven or the like.

BACKGROUND OF THE INVENTION

Devices for generating a circulation of air in an oven are known in the art. See, for example, U.S. Pat. Nos. 4,071,739 to Jenn et al; 4,262,183 to Smith et al. These patents describe use of built-in electric fans to force circulation of air in ovens and thus cause a more efficient and rapid heat transfer to the food. Other patents describing air circulation in ovens are U.S. Pat. Nos. 3,991,737, 4,108,139 and 4,109,636.

SUMMARY OF THE INVENTION

In an oven air circulator in accordance with the invention air circulation is created with a self-contained housing that can be placed at a convenient position in an oven with the food being heated. The housing has a manually windable spring motor that is connected to drive a propeller inside the housing to generate a flow of air from an outlet into the oven food heating chamber.

With an oven air circulator in accordance with the invention the air flow inside an oven can be directed to prevent the air from forming stratified heat layers food for a more even heating and cooking. The air circulator is preferably made of metal parts that withstand oven temperatures. The air circulator can be sized so as to be conveniently placed in the oven at corners or other spots without interference with food containers of normally encountered sizes.

The mechanical drive of an air circulator in accordance with the invention can be made to provide air circulation for a duration that is compatible with many food cooking times.

It is, therefore, an object of the invention to provide a self-contained, portable, oven air circulator that can accommodate long cooking periods.

These and other advantages and objects of the invention can be understood from the following description of a preferred form for an oven air circulator in accordance with the invention which is described with reference to the following drawings.

DETAILED DESCRIPTION OF DRAWINGS

Figure 1:
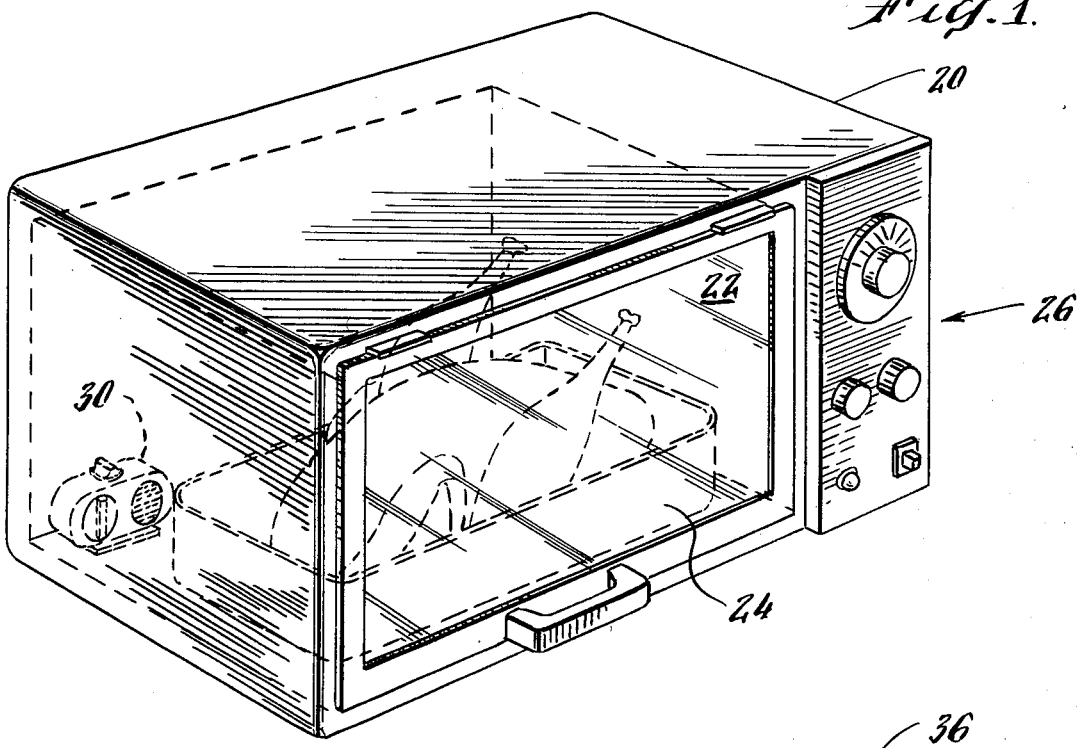
FIG. 1 is a perspective view of an air circulator in accordance with the invention inside an oven.

With reference to FIG. 1, an oven 20 is shown of a commonly available conventional type with a cooking chamber 22 containing food to be cooked such as a turkey in a pan 24. Controls 26 are provided to regulate the cooking temperature.

In order to create the circulation of air and thus achieve a more even cooking of the food, a self-contained portable air circulator 30 is placed in chamber 22. The air circulator is small enough to be placed at a convenient and available spot and may thus be as shown at the back of oven 20 or in the front or at the side, depending upon the size and shape of pan 24. Air circulator 30 is made sufficiently small so that it can even be placed on a shelf above or below pan 22.

Figure 2:
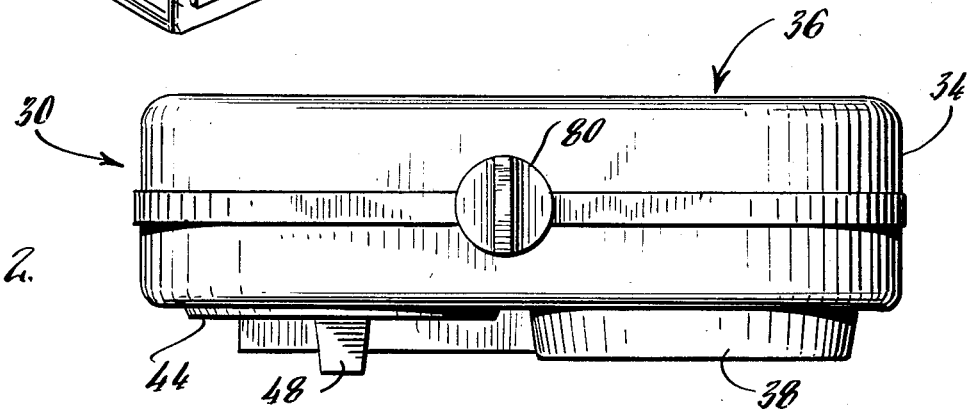
FIG. 2 is a top plan view of the air circulator of FIG. 1.
Figure 3:
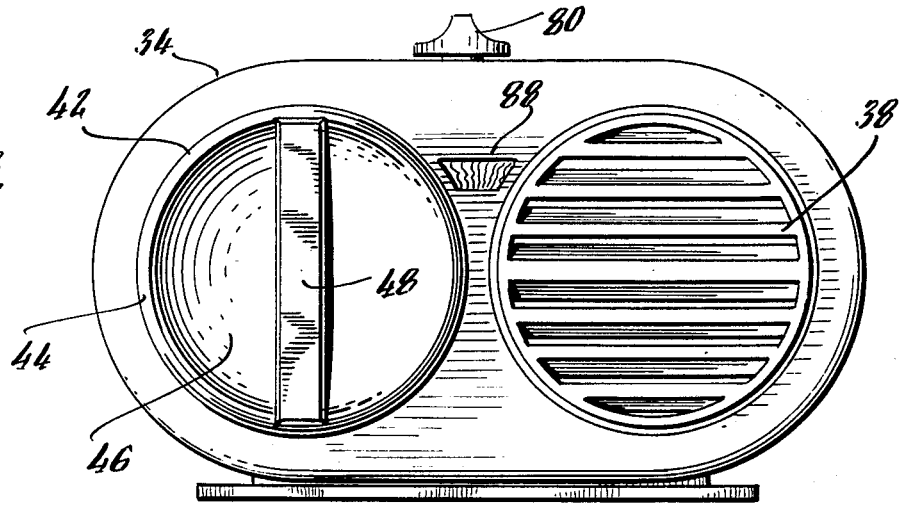
FIG. 3 is a front view in elevation of the air circulator of FIG. 1.

Air circulator 30 is fully self-contained by incorporating a spring motor 32, see FIGS. 4–6 and 7, inside and at one side of a housing 34, see FIGS. 2 and 3. Housing 34 includes an air inlet 36 and outlet 38 through which a flow of air is produced by a propeller 40 located at another side of housing 34, see FIGS. 4 and 5, and driven into rotation by spring motor 32. Propeller 40 is positioned between the inlet 36 and outlet 38. A spring wind-up lever 42 is connected to motor 32 and conveniently made in the form of a disc shaped knob 44 having a recessed surface 46 spanned by a centrally located grip 48.

Spring motor 32 employs a wind-up spring 50 which, as is well known in the art, can be coiled to store mechanical energy that is releasable through a reduction gear train 52 coupled to a spur 54 on shaft 56 of propeller 40. The springmotor 32 and gear train 52 are well known devices using large reduction gears 53 and spur gears 55, see for example U.S. Patent 1,362,653 to Turner wherein a spring motor is used to drive a fan.

Figure 5:
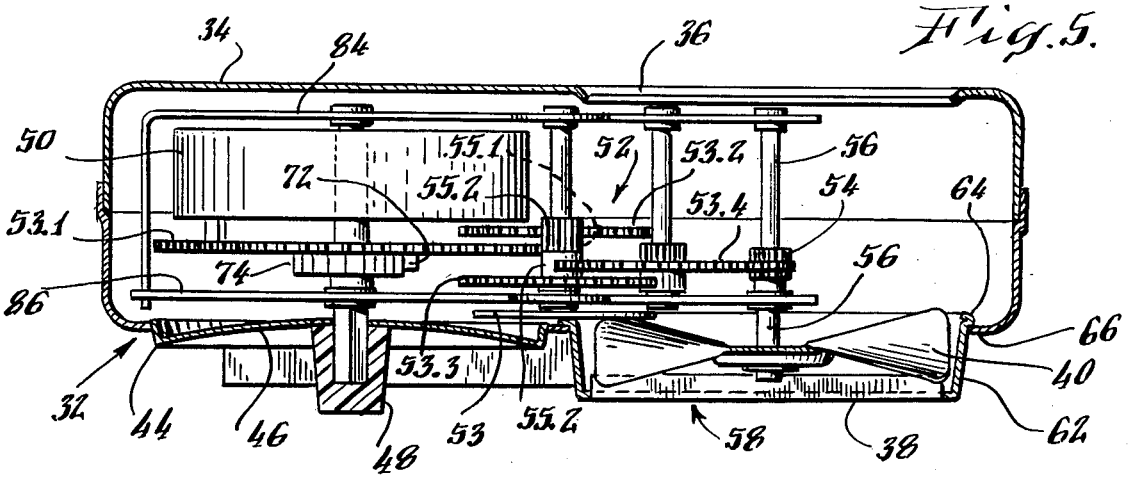
FIG. 5 is a section view of the air circulator as taken along the line 5—5 in FIG. 4.
Figure 4:
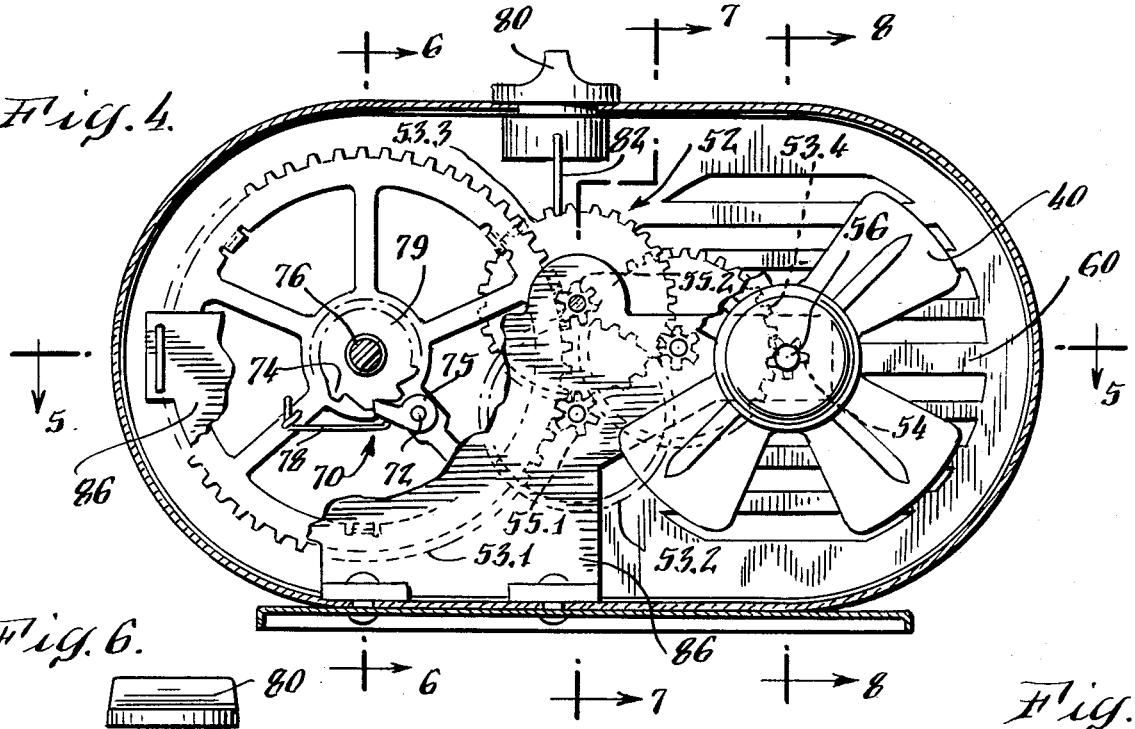
FIG. 4 is a broken-away front view in elevation of the air circulator of FIG. 1.
Figure 6:
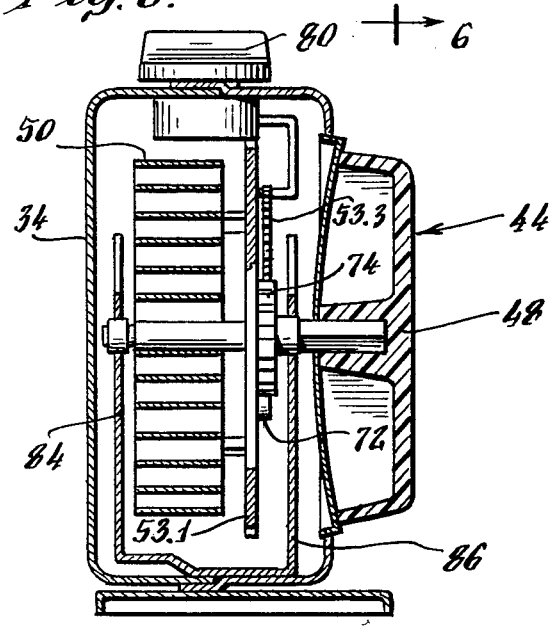
FIGS. 6, 7 and 8 are section views of the air circulator as respectively taken along the lines 6—6, 7—7, 8—8 in FIG. 4.
Figure 7:
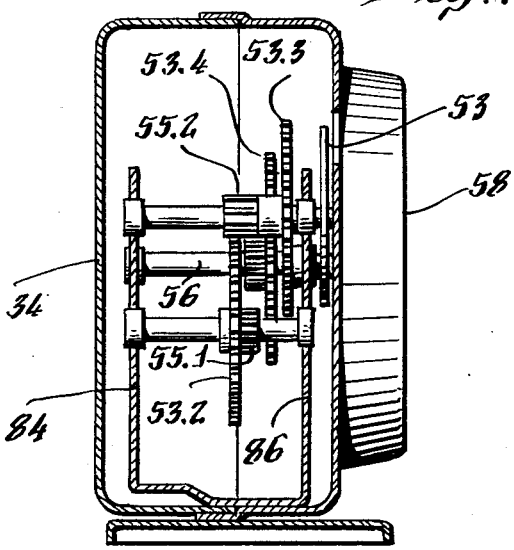
Figure 8:
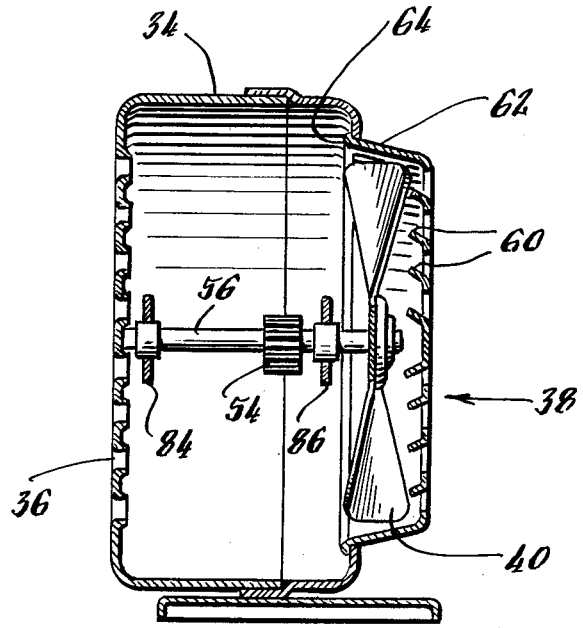

Propeller 40 is, as shown in FIG. 5, placed adjacent air outlet 38 to exhaust air therefrom in a direction as determined by a manually positionable, rotatable flow director 58. The air flow director is formed of a cylindrical coaming having at one axial end a plurality of parallel spaced angled louvers 60 which act as air deflectors. The flow director 58 has a peripheral circular rim 62 which has at one axial end an annular rib 64 that seats against an edge 66 in the wall of housing 34. The propeller 40 fits inside the rim 62 directly adjacent louvers 60.

Spring motor 32 includes a ratchet mechanism 70 formed of a pawl 72 and gear 53.1. Gear 53.1 is affixed to the output shaft 76 of the spring motor 32 and is engaged by pawl 72 which is pivotly connected at 75 to first reduction gear 53.1 in gear train 52. A spring 78 maintains pawl 72 in engagement with gear 53.1 during a drive of gear train 52 while allowing a clockwise rotation in the direction of arrow 79 of shaft 76 to wind spring motor 50. An on-off rotatable knob 80 is mounted to housing 34 and provided with a lever 82 shaped to engage gear teeth in gear train 52 to thus either inhibit or enable rotation of propeller 40.

Rotation of propeller 40 may last for a time dependent upon the degree of the wind-up of spring 50. Preferably spring 50 is selected so that propeller 40 can generate a useful circulation of air for one or several hours.

The amount of air flow from the air circulator is set sufficiently high to obtain the needed air circulation for a generally even distribution of heated air in the oven, but not so high as to reduce the running time for any one full spring wind-up to too low a level. It should be understood that complete uniformity of heated air is not practical since the oven heater generates high local temperatures. Generally an air flow of from about two to abut three cubic feet per minute from outlet 38 is sufficient to achieve generally uniform heated air distribution for many different foods and different ovens. Air flow can be expected to decrease as the spring motor winds down. Air flow below several cubic feet per minute may be sufficient. Generally, excessively high air flows are preferably aovided, lest these may have an undesirable effect on the food being cooked. An air circulation operating time for any one full wind-up of two hours can be achieved with a spring of about 0.010 inches thick, 0.5 inches wides and 100 inches long and reduction gear train 52 of about a 1250 to 1 ratio.

Figure 9:
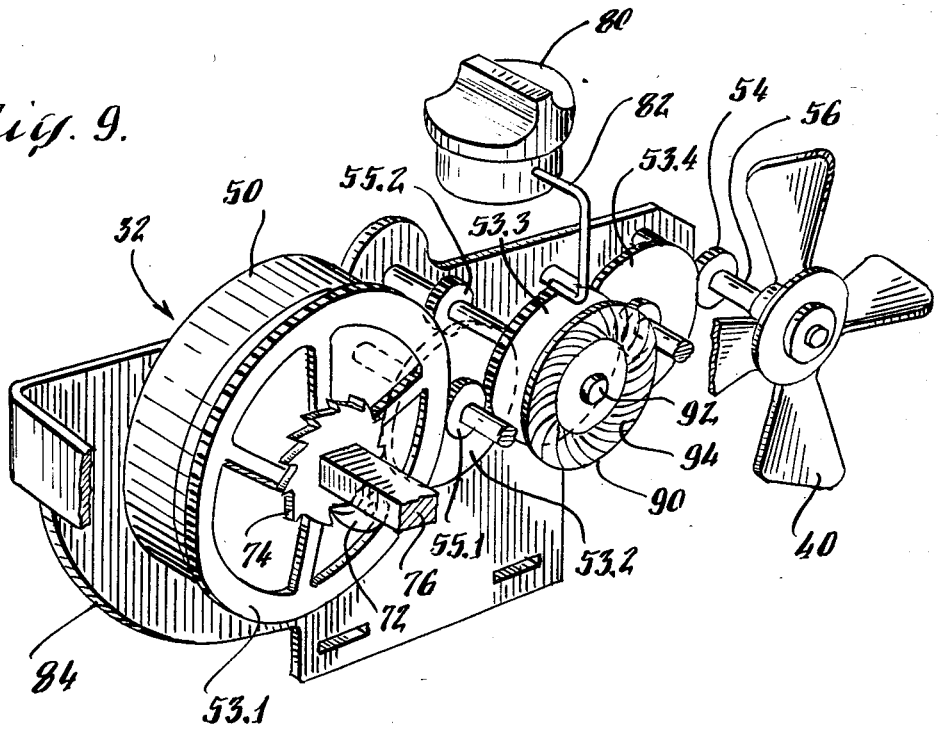
FIG. 9 is a perspective partially broken away view of a spring motor drive used in the air circulator as shown in FIG. 1.

The gear train 52 is selected to provide the desired drive for propeller 40. The gear train 52, spring motor 32 and propeller 40 are mounted to a pair of parallel spaced but connected brackets 84, 86, see FIG. 5. The number of reduction gears 53 and 55 employed depend upon the desired output speed of propeller 40. A window 88 (see FIG. 3) is provided in housing 34, so that operation of the air circulator can be observed. Window 88 is located opposite a disc 90 (see FIG. 9) affixed to a shaft 92 in gear train 52. Disc 90 has spirally oriented indicia 74 that move across window 88 when the air circulator is operating. All of the parts of the air circulator 30 are made of metal, preferably and to the extent possible of stamped-out parts so as to tolerate high oven temperatures yet at economical manufacturing costs.

With a device in accordance with the invention, a self-contained portable air circulator is provided capable of placement at a convenient place in an oven. A typical size of the entire circulator may, for example, be about 7.5 inches long, about 4 inches high and 2 inches thick. The amount of air circulated can be sufficient for most cooking requirements and made to last for a long time before requiring rewind-up. Various modifications can be made without departing from the scope of the invention.

What is claimed is:

1. An air circulator for an oven having a food heating chamber comprising:

a compact self-contained portable housing sized to fit within the oven chamber with food being heated therein and shaped to stand by itself within the oven; said housing having a to one lateral side thereof a manually windable spring motor mounted therein and having to another lateral side an air outlet and an air inlet; a propeller mounted to fit within the housing at the other lateral side thereof between the air inlet and air outlet so that said spring motor is not in the path of the flow of air between the air inlet and air outlet parts; and reduction gear means inside the housing and coupling the spring motor to the propeller for rotating the propeller and supplying a flow of air from the outlet port into the food heating chamber, said air circulator being made of metal parts capable of operating inside a heated oven.

2. The air circulator for an oven as claimed in claim 1 wherein the spring motor and reduction gear means are selected to drive the propeller at a speed sufficient to establish a generally even distribution of heated air in the food heating chamber.

3. The air circulator for an oven as claimed in claim 1 wherein the self-contained housing is further provided with an air flow director located in front of the air outlet to direct the direction of said flow of air.

4. The air circulator for an oven as claimed in claim 1 wherein the reduction gear means rotates the propeller at a speed selected to produce said flow of air in the range from about two to about three cubic feet per minute over a desired time interval.

5. The air circulator as claimed in claim 3 wherein the air flow director is formed with a plurality of louvers oriented to deflect the flow of air from the propeller.

6. The air circulator as claimed in claim 5 wherein the air flow director is mounted for rotation with respect to the housing to deflect air flow.

7. The air circulator as claimed in claim 2 wherein the housing is formed of sheet metal and has a window and means operatively connected to the reduction gear means and positioned at said window to indicate the operation of the air circulator.

8. An air circulator for an oven having a food heating chamber comprising:

a compact self-contained portable housing sized to fit within the oven chamber with food being heated therein, said housing enclosing a manually windable spring motor located on one side of the housing, a manual wind-up lever connected to the spring motor and mounted on said one housing side;

a propeller located in the housing at the other side of the housing, a reduction gear train inside the housing and interconnecting the spring motor to the propeller, said housing having an air inlet and air outlet at said other side of the housing with the propeller located between the inlet and the outlet to cause a circulation of air from the outlet when the spring motor is wound up without the exposure of the spring motor to the flow of air between the air inlet and air outlet parts, said housing, motor, lever, propeller and reduction train being made of metal to enable operation inside a heated oven.

9. The air circulator for an oven as claimed in claim 8, wherein the spring motor and reduction gear train rotate the propeller at a speed so as to cause an air flow sufficient to produce a generally even distribution of heated air in the heating chamber over a time period of up to about several hours on a single full wind-up of the spring motor.

10. The air circulator for an oven as claimed in claim 9 wherein the housing is provided at said other side and air outlet with a rotatably positionable air flow deflector, said air flow deflector being formed of a generally cylindrical coaming with air deflectors arranged in parallel spaced relationship across one axial end at the air outlet and wherein said cylindrical coaming projects from said housing and peripherally extends in general coplanar relationship with the propeller.

* * * * *